US009752366B2

(12) United States Patent
Pellegrini

(10) Patent No.: US 9,752,366 B2
(45) Date of Patent: Sep. 5, 2017

(54) SLIDING DOOR DEVICE FOR LATERALLY OPENING A DOOR OF A PASSENGER VEHICLE, AND PASSENGER VEHICLE WITH SLIDING DOOR DEVICE

(71) Applicant: GEBR. BODE GMBH & CO. KG, Kassel (DE)

(72) Inventor: Andreas Pellegrini, Kassel (DE)

(73) Assignee: GEBR. BODE GMBH & CO. KG, Kassel (DE)

( * ) Notice: Subject to any disclaimer, the term of this patent is extended or adjusted under 35 U.S.C. 154(b) by 0 days.

(21) Appl. No.: 14/911,111

(22) PCT Filed: Sep. 26, 2014

(86) PCT No.: PCT/EP2014/070634

§ 371 (c)(1),
(2) Date: Feb. 9, 2016

(87) PCT Pub. No.: WO2015/044357

PCT Pub. Date: Apr. 2, 2015

(65) Prior Publication Data

US 2016/0194910 A1 Jul. 7, 2016

(30) Foreign Application Priority Data

Sep. 30, 2013 (DE) ..... 20 2013 104 443 U

(51) Int. Cl.
*E05F 11/38* (2006.01)
*E05D 15/10* (2006.01)
(Continued)

(52) U.S. Cl.
CPC ..... *E05D 15/1047* (2013.01); *E05D 15/0686* (2013.01); *E05D 15/1081* (2013.01);
(Continued)

(58) Field of Classification Search
CPC ..... E05D 15/1047; E05D 15/0686; E05D 15/1081; E05F 15/00
(Continued)

(56) References Cited

U.S. PATENT DOCUMENTS 4,644,690 A * 2/1987 Caimi ..... E05D 15/10 49/128
4,942,694 A * 7/1990 Simoncelli ..... E05D 15/5211 49/192
(Continued)

FOREIGN PATENT DOCUMENTS

DE 2020576 A 11/1971
DE 20015649 U1 12/2000
(Continued)

OTHER PUBLICATIONS

International Search Report dated Nov. 24, 2014 re: Application No. PCT/EP2014/070634; pp. 1-2; citing: DE 10 2010 027136 A1, EP 1 488 977 A1and DE 200 15 649 U1.

*Primary Examiner* — Jerry Redman
(74) *Attorney, Agent, or Firm* — Cantor Colburn LLP

(57) ABSTRACT

A sliding door device for laterally opening a door of a passenger vehicle includes a door and a drive device for moving the door transversely to and along the longitudinal axis of the vehicle. The door is flush with the lateral wall of the vehicle in the closed state, and in the open state, the door lies outside against the lateral wall. The drive device is arranged below or above the door opening and includes a support to which a first rotor is movably attached along the longitudinal axis of the support. A second rotor can be moved relative to the support along the longitudinal axis of the support by moving the first rotor, the door is attached to the second rotor, and the support is movably mounted relative to the vehicle transversely to the longitudinal axis of the vehicle. The first rotor is connected to a driving element which is guided within a first guide track that is fixed to the vehicle, and a second guide track is located on the vehicle on the door opening side opposite the drive device, a guide element which is connected to the door guided in the second guide track.

10 Claims, 5 Drawing Sheets

(51) Int. Cl.
*E05D 15/06* (2006.01)
*E05F 15/00* (2015.01)
*E05F 15/643* (2015.01)

(52) U.S. Cl.
CPC ..... *E05F 15/00* (2013.01); *E05D 2015/1097* (2013.01); *E05F 15/643* (2015.01); *E05Y 2800/122* (2013.01); *E05Y 2900/531* (2013.01)

(58) Field of Classification Search
USPC ..... 49/360, 209, 210, 211, 213, 221, 254
See application file for complete search history.

(56) References Cited

U.S. PATENT DOCUMENTS 5,271,181 A * 12/1993 Pietro ..... B60J 5/062 49/118
5,893,236 A * 4/1999 Krbec ..... B61D 19/008 49/118
6,209,264 B1 * 4/2001 D'Abreu ..... E05B 47/0012 49/210
6,336,246 B1 * 1/2002 Giovannetti ..... E05D 15/1005 16/87 R
7,509,773 B2 * 3/2009 Vornbaumen ..... E05F 11/423 49/209
8,096,629 B2 * 1/2012 Halfon ..... E05D 15/0652 312/319.7
8,984,810 B2 * 3/2015 Bortoluzzi ..... E05D 15/1042 312/139
9,157,264 B2 * 10/2015 Bortoluzzi ..... E05D 15/1042
2001/0027621 A1 * 10/2001 Davies ..... G09F 23/06 49/360
2014/0026488 A1 * 1/2014 Andersson ..... E05D 15/1065 49/210

FOREIGN PATENT DOCUMENTS

DE 102010027136 A1 1/2012
EP 1488977 A1 12/2004
WO 02081244 A1 10/2002

* cited by examiner

SLIDING DOOR DEVICE FOR LATERALLY OPENING A DOOR OF A PASSENGER VEHICLE, AND PASSENGER VEHICLE WITH SLIDING DOOR DEVICE

TECHNICAL FIELD

The disclosure relates to a sliding door device for the lateral door opening of a passenger vehicle, at least comprising a door and a drive device for moving the door transversely to and along the longitudinal axis of the passenger vehicle, wherein the sliding door device is configured in such a way that the door, in the closed state, is aligned with the side wall of the passenger vehicle, whereas the door, in the opened state, rests outside against the side wall of the passenger vehicle.

BACKGROUND

Sliding door device of this kind are known, possibly being configured, for example, as pivot sliding doors as is typically the case in vehicles for public transport. For example, DE 2 020 576 discloses such a pivot sliding door device for a vehicle, wherein the door is pivoted outwards by means of parallelogram guide rods and displaced by means of a telescopic guide above the door opening.

In the field of passenger vehicles, or in the field of the commercial vehicles and minivans, sliding door devices are also known in which a door can be displaced between a closed and an opened position by means of corresponding sliding door guides. In the process, three rails are usually employed, with an upper and a lower rail being respectively provided in the door opening. Moreover, a middle sliding and guide rail on the outside of the side wall is used for guiding the door on the outside along the side wall. An electrification of the door by means of a drive unit is also usually realized in this middle rail.

However, the middle rail affects the appearance of the vehicle considerably. Because this middle rail is exposed to the effects of the weather, it must further be formed from corresponding materials that disadvantageously increase the price of manufacture of the vehicle. Therefore, there are various approaches in the prior art as to how to eliminate the middle rail. For example, EP 1 372 999 B1 discloses a solution in which the middle rail is attached to the inside of the door.

However, a drive unit of the door cannot always be realized in a satisfactory manner even given a rail on the inside of the door. It usually comprises cables with which the door is moved back and forth, with the drive motor for moving the cables being located on the vehicle. Thus, a connection between the drive motor and the door must be established by means of the cables, which may result in various problems due to the door moving constantly. Furthermore, the cables are susceptible to failure.

The disclosure provides a sliding door device for the lateral door opening of motor vehicle that does not require a middle guide rail, wherein the sliding door device is supposed to be, in particular, simple to electrify and insusceptible to failure. Furthermore, the disclosure provides a passenger vehicle with such a sliding door device.

SUMMARY

The sliding door device according to the disclosure for the lateral door opening of a passenger vehicle comprises at least a door and a drive device for moving the door transversely to and along the longitudinal axis of the passenger vehicle. Here, within the sense of the disclosure, transverse to the longitudinal axis means a movement at an angle of 1-90° to the longitudinal axis of the vehicle, while along the longitudinal axis means a movement parallel to the longitudinal axis of the vehicle. However, these movements need not take place separately from each other, but may also take place simultaneously, so that a door can be displaced away from the door opening and parallel to the side wall at the same time. In this case, the sliding door device is configured in such a way that the door, in the closed state, is aligned with the side wall of the passenger vehicle, whereas the door, in the opened state, rests outside against the side wall of the passenger vehicle. The drive device of the device can be disposed below or above the door opening of the passenger vehicle and comprises a support to which a first slide is attached in a manner displaceable along the longitudinal axis of the support. Due to this movement of the first slide, a displacement of a second slide relative to the support along the longitudinal axis of the support can be caused via a transmission. Further, the door is attached to the second slide, the attachment preferably being a non-rotatable connection.

Thus, the movement of a slide simultaneously causes the movement of the respective other slide relative to the first slide, whereby the travel distance of the door can be increased as compared with other solutions with only one displaceable slide. In one embodiment of the disclosure, the traversing distance of the door between the open position and the closed position is therefore greater than the travel distance of the first slide along the support. For this purpose, the two slides may, for example, be configured as two telescopic sliding rails in which the second sliding rail is movable within the first sliding rail. A telescopic guide is advantageous in that the guide can be configured in a compact manner, wherein it can be configured in a compact manner particularly relative to the opening width of the door. However, this slide connection and particularly the above-described telescopic guide have to be synchronized in order for the movement of the sliding rails to be uniform.

According to the disclosure, the support is furthermore displaceably mounted, relative to the passenger vehicle, in a direction transverse to the longitudinal axis of the passenger vehicle. This may be an angle in the range from, for instance, 80-100°; preferably, however, the support can be displaced at an angle of about 90° to the longitudinal axis of the vehicle. Also by means of these measures, a very compact drive device can be realized. In this case, the drive device does not have to extend over the entire width of the door opening, but may be, for example, only half as wide. Furthermore, no movable parts of the drive device, which in turn are connected to components that move relative to the vehicle during the opening and closing process, have to be accommodated on the vehicle itself. Rather, all movable components of the drive device can be attached to the support, with the support with all components constituting a compact unit, which in its entirety is movable relative to the vehicle.

According to the disclosure, the first slide is connected to a driver guided within a first guide track that is fixedly located on the passenger vehicle, and a second guide track, in which a guide member is guided that is connected to the door, is located on the side of the door opening opposite from the drive device. The guide member within the second guide track may be, for example, a guide roller firmly connected to the inside of the door via a guide arm. The drive device and the door connected therewith can be moved transversely to and along the longitudinal vehicle axis by means of the driver and the guide member within the upper or lower guide track, if the guide tracks are formed accordingly. In particular, the guide tracks have straight and curved sections for this purpose. In this case, the guide track of the drive device can also be referred to as the primary guide, while the opposite guide is to be referred to as the secondary guide. Since the synchronized guide experiences a different speed than the door during the opening and closing of the door, different geometries for the upper and the lower guide track are the result.

Such a sliding door device can be configured so that it can be manually operated or electrically driven. In the case of a manual operation, the drive device is provided to direct a manually generated movement of the door into the required track by the driver being moved in the associated guide track. In this case, the door should be as easy to open and close as possible, and also in this case, it is advantageous that the slides or sliding rails that can be displaced relative to each other facilitate the movement of the door. In one embodiment of the disclosure, however, the drive device comprises a drive unit with which the driver can be moved in the first guide track, whereby the first slide is displaceable along the support. The door is thus driven by the movement of the driver in its guide track. In this case, the drive unit is preferably connected to the support of the drive device, so that it is movable relative to the vehicle as a part of the compact drive device and moves together with the door.

The transmission between the two slides can be realized in different ways. For example, a first toothed rack that is stationary relative to the first slide and at least one first gear wheel, which is mounted on the first slide and which is in meshing engagement with the first toothed rack, may be provided. The rotary movement of the gear wheel then causes a relative movement of the slide, and thus of the door. In order to achieve a reliable operation, the transmission preferably comprises a second toothed rack attached to the door leaf, with which the first gear wheel or a second gear wheel operatively engaged with the first gear wheel is in meshing engagement.

The support may be displaceable transversely to the longitudinal motor vehicle axis by means of a linear guide. For this purpose, the support, for example, may have two lateral rails guided in two guides that are firmly connected to the motor vehicle, the rails extending on the support and the guides extending on the motor vehicle, transversely to the longitudinal vehicle axis. Rollers, which roll within the guides during a movement of the rails, may be attached to the rails.

In one exemplary embodiment of the disclosure, the support is furthermore rotatably mounted about an axis on the linear guide that extends parallel to the longitudinal axis of the support. In that case, the support is rotatable relative to the lateral rails, for example via bolts. This mounting compensates positional tolerances and arising deviations between the upper and the lower guide.

In a preferred embodiment of the disclosure, the drive device is attached below the door opening, i.e. in the area of the sill. In this case, in may be provided, for example, that the drive device is inserted into a sill of the motor vehicle. The deploying support may in that case be used as a step, for example.

In total, only two guide rails above and below the lateral door opening of a passenger vehicle are thus required, while a middle guide rail may be dispensed with. This has the advantage that the design of the side wall of the vehicle can be configured in a simpler manner, which, in addition to technical advantages, also entails advantages with regard to costs. Moreover, the sliding door device can be electrified more easily. On the one hand, no cables are required that are exposed to the weather. Furthermore, the drive device moves together with the door, so that no failure-susceptible connection between the drive unit and the door is present.

The disclosure also includes a passenger vehicle comprising at least a door opening and a sliding door device with a door, wherein the sliding door device is configured in such a way that the door, in the closed state, is aligned with the side wall of the motor vehicle, whereas the door, in the opened state, rests outside against the side wall of the motor vehicle. According to the disclosure, the sliding door device is in this case configured in accordance with one or more of the above-described embodiments. The motor vehicle is a transporter, delivery van, minivan or minibus, for example.

Other advantages, special features and expedient further developments of the disclosure are apparent from the following presentation of preferred embodiments with reference to the illustrations.

DETAILED DESCRIPTION OF THE DRAWINGS

Figure 1:
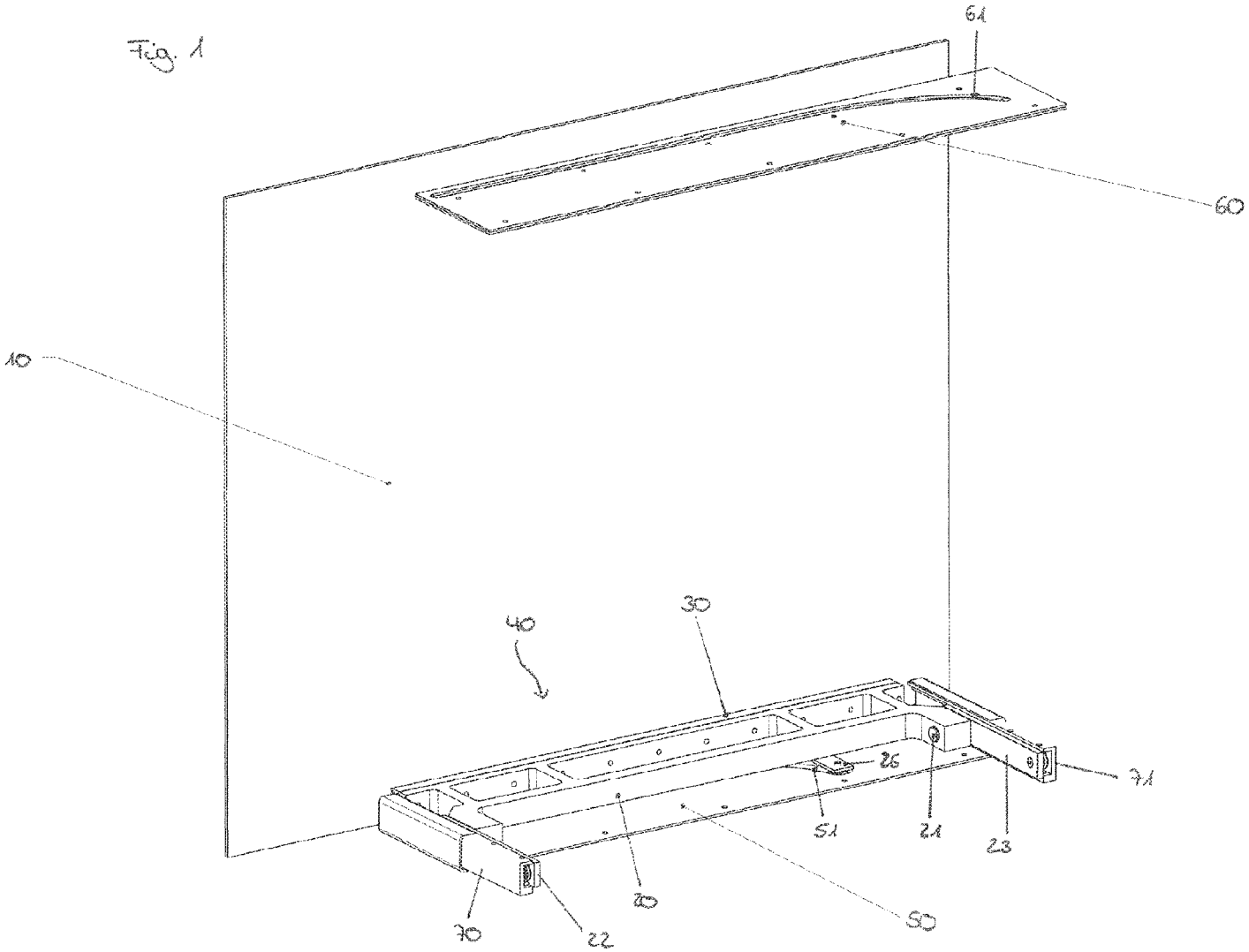
FIG. 1 shows a schematic representation of an exemplary embodiment of the sliding door device according to the disclosure in the closed state of the door.

The schematic representation of an exemplary embodiment of the sliding door device according to the disclosure in FIG. 1 shows the sliding door 10 of a passenger vehicle in the closed state. In this case, the motor vehicle and the door opening that the sliding door closes are not shown. The vehicle can be, in particular, a commercial vehicle, a minivan or a minibus with a lateral sliding door. Of the vehicle, only an upper guide track 61 and a lower guide track 51 are shown, which are inserted into respective guide plates 50 and 60 that are firmly attached to the vehicle. The guide plates 50, 60 may be separate components that are suitably attached to the vehicle. This may be done, for example, by means of a screw connection or other suitable means. However, the guide tracks 51, 61 may also be inserted directly into panels of the vehicle, so that no attachment of additional guide plates is necessary.

Figure 2:
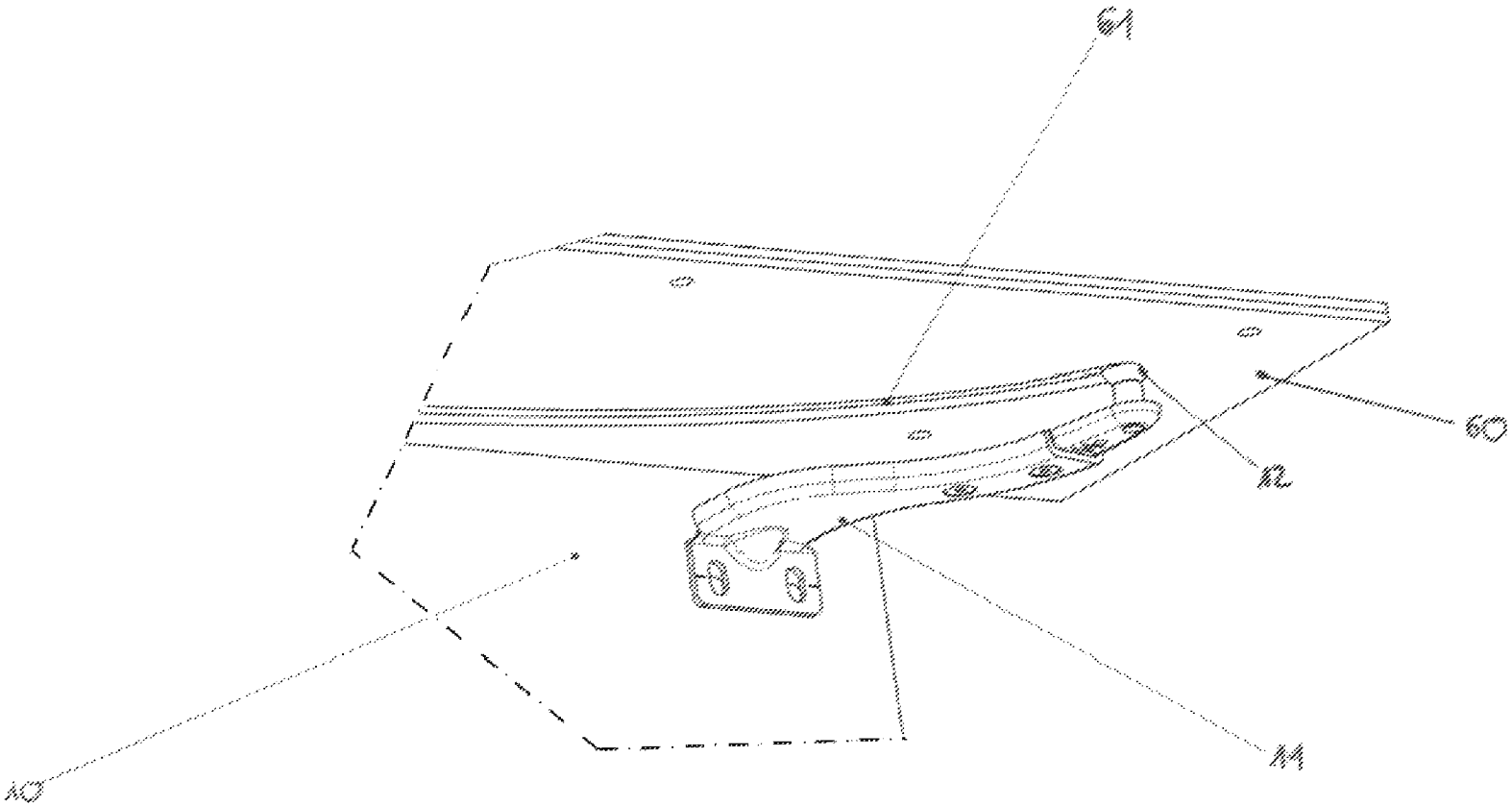
FIG. 2 shows an enlarged detailed view of the guide of the door within an upper guide track.

The upper and lower guide tracks 61, 51 are respectively located above and below the door opening, which is not shown. A guide roller 12 as it is shown in the enlarged view of FIG. 2 is guided in the upper guide track 61. This guide roller 12 is attached to a guide arm 11 which is preferably non-rotatably connected to the inside of the door 10. In this case, the guide track 61 has a straight section and a section curved at the end side. The curvature runs in the direction of the inside of the vehicle, whereby the door 10 is guided on a trajectory which, upon opening the door 10, first extends away from the door opening and then along the outside of the vehicle. The lower guide track 51 also takes such a course that is curved at the end side, the geometries of the two guide tracks 51, 61, however, not being identical.

A drive device with which the door can be moved manually or in an electrically driven manner between closed and open states is provided below the door opening, which is not shown. In this case, FIG. 1 shows a drive device 40 that is to be driven manually. The drive device 40 substantially comprises a support 20 which is mounted on the vehicle so as to be transversely displaceable relative to the longitudinal axis of the motor vehicle. In the exemplary embodiment shown, this is done, for example, via two rails 22 and 23 that are laterally attached to the support 20. The rails 22, 23 comprise rollers traveling in guides 70 and 71 that are firmly attached to the vehicle. Thus, the entire support 20 and all components connected therewith can be moved transversely to the longitudinal axis of the vehicle. In this case, the support 20 is preferably rotatably mounted between the rails 22, 23, which may be done via bolts 21, for example.

Figure 4:
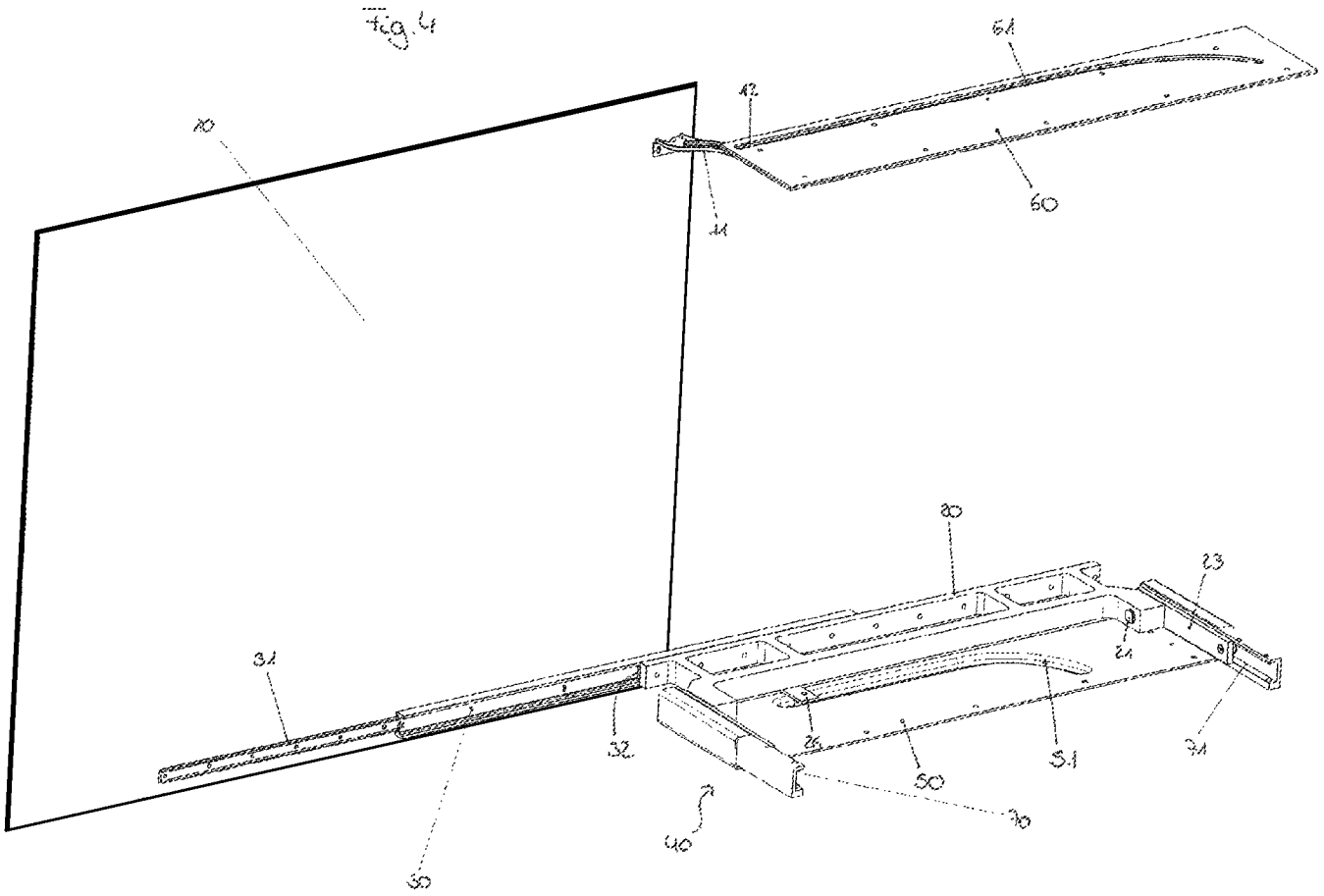
FIG. 4 shows the sliding door device according to FIG. 1 in the open state of the door.

A first slide 30, which can be displaced relative to the support 20 along the longitudinal axis of the support 20, is attached to the support 20. This displacement substantially takes place parallel to the longitudinal axis of the vehicle, but may also take place slightly offset thereto, depending on the configuration of the door. The displacement may take place, for example, by the first slide 30 being configured as a rail with a C-shaped cross section grasping around a rail that is firmly attached to the support 20. Preferably, the slide 30 is in this case configured as a kind of T-profile, to that it is capable of grasping around the second slide 31 on the other side. This is shown in FIG. 4, which shows the drive device 40 in the deployed situation. One side of the sliding rail 30 grasps around a receiving rail 32 on the support 20, while the other side grasps around the second sliding rail 31.

A driver 26, which is guided within the lower guide track 51, is connected to the first slide 30, which consequently may also be referred to as a sliding rail. A movement of the driver 26 within the guide track 51 thus causes a corresponding movement of the sliding rail 30 and vice versa. In this case, the driver 26 may also be guided in the guide track by means of a guide roller.

Figure 3:
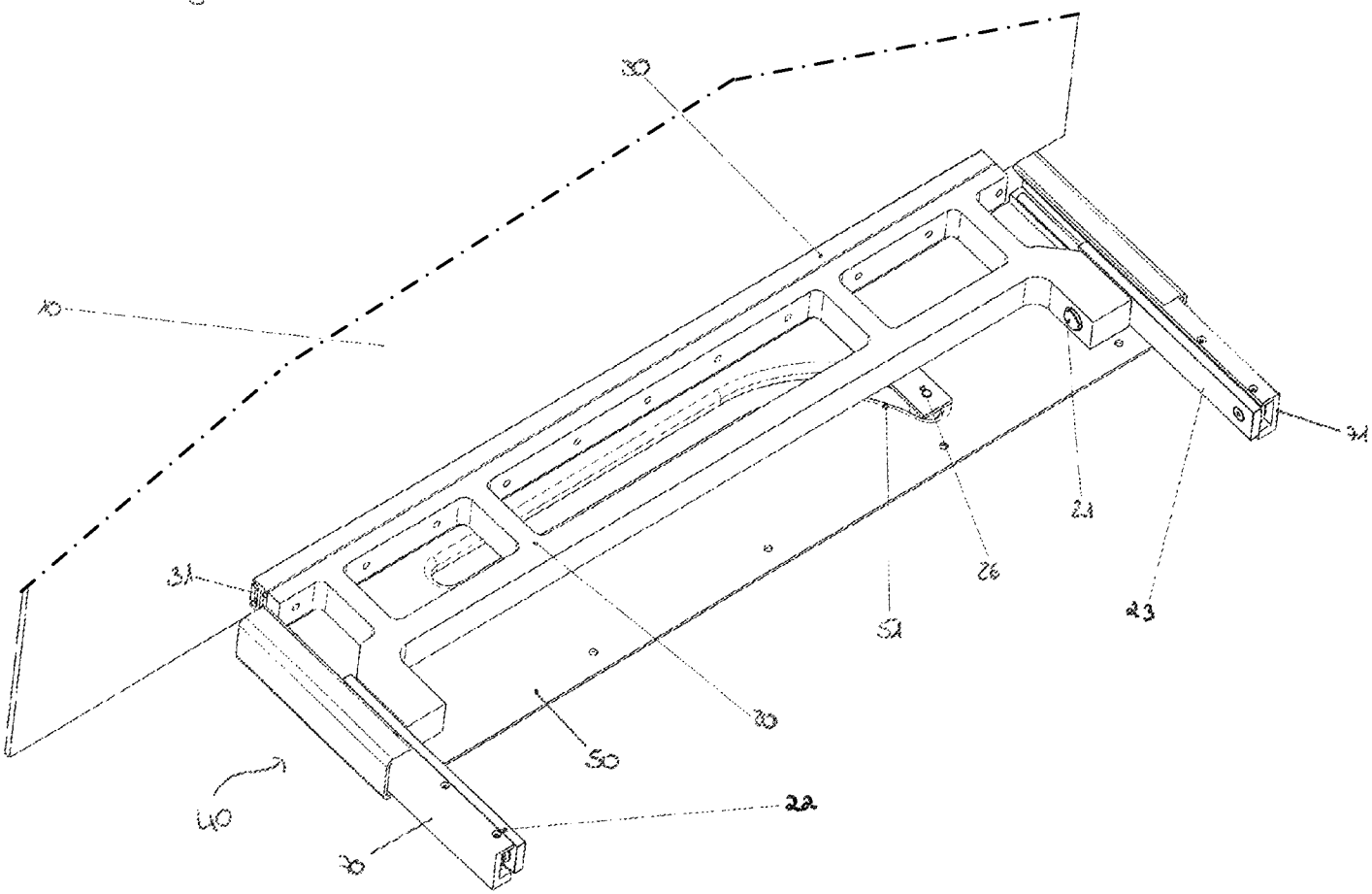
FIG. 3 shows a detailed view of the drive device in the closed state of the door.

FIG. 3 once again illustrates this arrangement in another view, in which the course of the lower guide track 51 can be seen within which the driver 26 is located. Here, it is also apparent that the second sliding rail 31 is disposed within the first sliding rail 30. This second sliding rail 31 is displaceably mounted within the first sliding rail 30, it being extendable from the first sliding rail 30 towards the left-hand side in FIG. 3. In FIG. 3, however, the door 10 is in the closed state in which the second sliding rail 31 is preferably completely, or at least to a very great extent, retracted into the first sliding rail 30. In this state, the driver 26 is located at the end of the curved section of the guide track 51, and the support 20 has traveled to such an extent towards the inside of the vehicle via the rails 22, 23 in the guides 70, 71 that the door 10 completely closes the door opening and is aligned with the side wall of the vehicle.

In contrast, FIG. 4 shows the sliding door device in the open state of the door 10. The opening process was carried out manually by the door having been unlocked and then displaced out of the door opening and along the side wall of the vehicle. In the process, the door 10 is attached to the second slide 31, and the second slide 31 is completely deployed from the first slide 30. The driver 26 is located at the end of the straight section of the lower guide track 51. In order for the door 10 to have been able to reach this end position, the manual displacement of the door 10, due to the curvature of the lower guide track 51, caused a displacement of the carrier 20 transverse to the longitudinal vehicle axis and a displacement parallel to the longitudinal vehicle axis at the same time. Thus, the door 10 was first moved out of the door opening, and then along the outside of the side wall of the motor vehicle.

Conversely, in the manual closing process, the movement is reversed, so that the door 10 is first displaced parallel to the longitudinal vehicle axis along the side wall when the driver 26 is guided through the straight part of the lower guide track 51. Once the driver 26 has reached the curved part of the guide track 51, there is also a movement transverse to the longitudinal vehicle axis into the door opening, until the door 10 is aligned with the side wall of the vehicle in the closed state.

The second slide 31 and the first slide 30 are in this case coupled with each other via a transmission in such a way that a movement of one slide simultaneously causes a movement of the respective other slide. A displacement of the door 10, and thus of the second slide 31 attached thereto, therefore simultaneously causes a synchronized movement of the first slide 30 in the same direction. The transmission is not shown in detail in the Figures, but may be realized in a suitable manner. For example, a transmission manufactured from plastic may be provided in order to keep the noise development at a low level. For this purpose, a gear wheel that is in meshing engagement with a toothed rack rigidly attached to the support 20 is provided at the connection between the first and the second slides. At the same time, the gear wheel is in meshing engagement with a second toothed rack attached to the door leaf, in order to convert, driven by the relative movement of the first slide 30, this rotary movement into a translational movement of the toothed rack and thus of the door leaf relative to the first slide 30. The travel distance of the door leaf, which is normally determined by the longitudinal extension of the drive device and limited by the width of the door opening, is thus increased. At least a doubling of the travel distance of the first slide 30 can thus be achieved, for example. Other conditions are also conceivable through an optionally different transmission design, also a multi-stage design, comprised by the disclosure.

Figure 5:
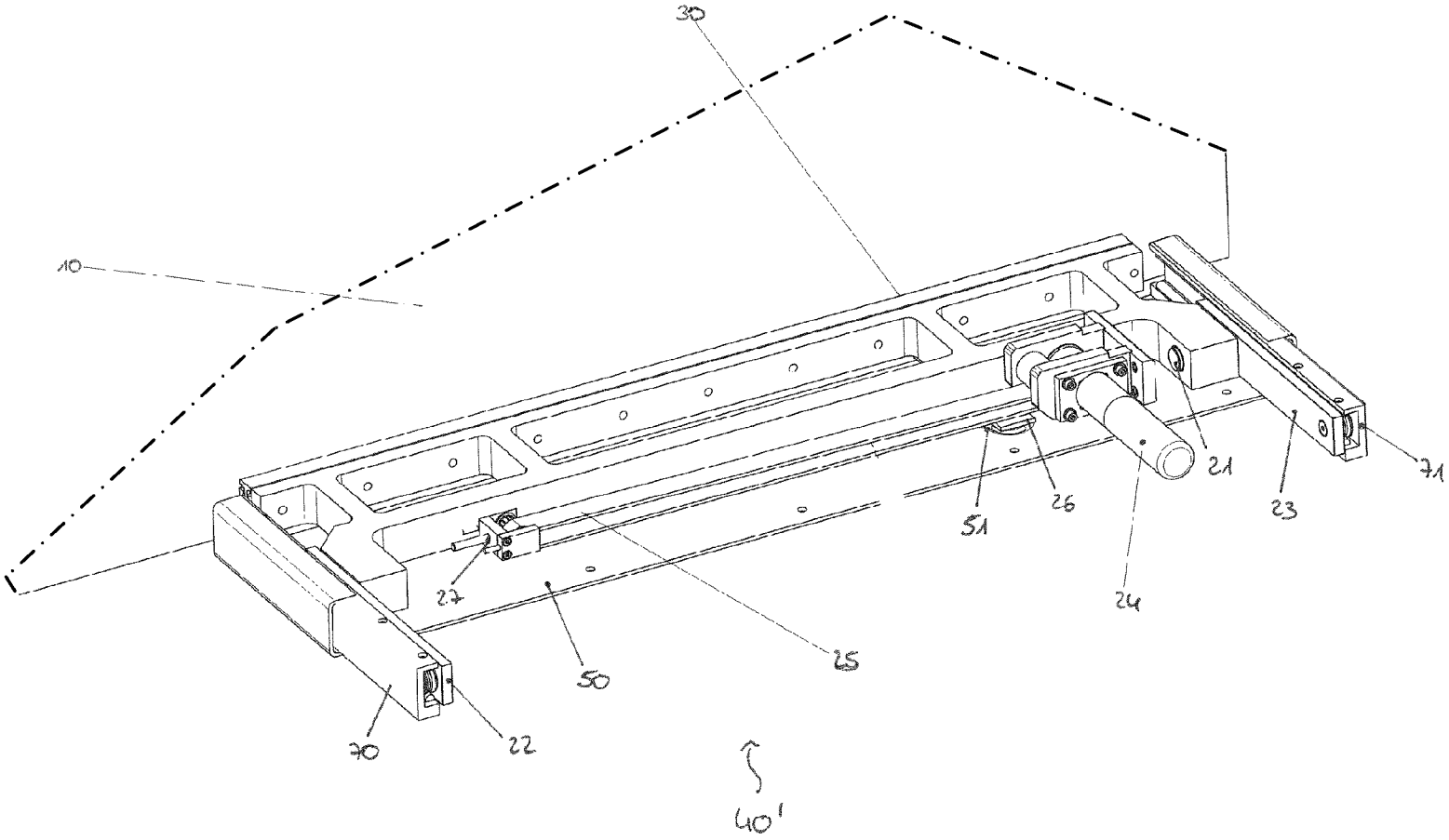
FIG. 5 shows a drive device according to FIG. 3 with an electronic drive unit.

FIG. 5 shows a drive device according to FIG. 3 in an electrified embodiment. In this drive device 40', an electric motor 24, for example, is attached to the support 20. This electric motor 24 drives a circulating toothed belt 25 with which the driver 26 is connected. In this case, the toothed belt is guided around a bracket 27 that is also attached to the support 20. In this way, the driver 26 can be moved back and forth between this bracket 27 and the electric motor 24, so that the first slide 30 connected to the driver 26 can also be moved along the support. However, any other kind of a suitable drive unit or transmission of forces between an electric motor 24 and the driver 26 may be adopted.

Due to the curvature at the end side of the lower guide track 51 and the transverse displaceability of the entire drive device 40' within the guides 70, 71, a movement of the driver 26 along the toothed belt 26 at the same time also causes a movement of the drive device 40' transverse to the longitudinal vehicle axis when the driver 26 moves through the curved part of the guide rail 51, i.e. at the beginning of the opening process and at the end of the closing process.

Also in this case, the driver 26 is in connection with the first slide 30, so that a driven movement of the first slide 30 synchronously deploys the second slide 31 from the first slide 30 because of the electric motor 24. Because the door 10 is attached to the second slide 31, the travel distance that can be achieved by the movement of the driver 26 thus multiplies. In the process, the second slide 31 always moves into, or out from, the first slide 30 to the approximate extent the first slide 30 has been displaced relative to the support 20, and vice versa. Thus, the door 10 may not only be moved by the distance corresponding to the distance between the bracket 27 and the electric motor 24 but, depending on the design of the transmission between the first and the second slides, the travel distance can be at least doubled.

It is also apparent from FIG. 5 that the entire drive device 40' was moved outwards within the lateral guides 70 and 71. Furthermore, it can be seen that the geometries of the two guide tracks 51 and 61 are not identical. In particular, the straight part of the upper guide track 61 is longer than the straight section of the lower guide track 51, because the travel distance of the driver 26 is shorter than the travel distance of the upper guide roller 12 due to the telescopic guide.

The invention claimed is:

1. A sliding door device for a lateral door opening of a passenger vehicle, comprising a door and a drive device for moving the door transversely to and along a longitudinal axis of the passenger vehicle, wherein the sliding door device is configured such that the door, in a closed state, is aligned with a side wall of the passenger vehicle, whereas the door, in an opened state, rests outside against the side wall, and the drive device is disposed below or above a door opening of the passenger vehicle and comprises a support to which a first slide is attached in a manner displaceable along a longitudinal axis of the support, wherein, due to the displacement along the longitudinal axis of the support of the first slide, a displacement of a second slide relative to the support along the longitudinal axis of the support is caused via a transmission, and the door is attached to the second slide, and that the support is displaceably mounted, relative to the passenger vehicle, in a direction transverse to the longitudinal axis of the passenger vehicle, and the first slide is connected to a driver guided within a first guide track that is fixedly located on the passenger vehicle, and a second guide track, in which a guide member is guided that is connected to the door, is located on the side of the door opening opposite from the drive device.

2. The sliding door device according to claim 1, wherein the drive device comprises a drive unit with which a driver is moved in the first guide track, whereby the first slide is displaceable along the support.

3. The sliding door device according to claim 2, wherein the drive device is connected to the support.

4. The sliding door device according to claim 1, wherein a traversing distance of the door between an open position and a closed position is greater than a travel distance of the first slide along the support.

5. The sliding door device according to claim 1, wherein the transmission comprises a first toothed rack that is stationary relative to the first slide and at least one first gear wheel, which is mounted on the first slide and which is in meshing engagement with the first toothed rack, the rotary movement of the first gear wheel causing a relative movement of the door.

6. The sliding door device according to claim 1, wherein the support is displaceable transversely to the longitudinal axis of the passenger vehicle by means of a linear guide.

7. The sliding door device according to claim 6, wherein the support has two lateral rails guided in two guides that are connected to the passenger vehicle, the rails extending on the support and the guides extending on the passenger vehicle transversely to the longitudinal axis of the passenger vehicle.

8. The sliding door device according to claim 6, wherein the support is rotatably mounted about an axis on the linear guide that extends parallel to the longitudinal axis of the support.

9. The sliding door device according to claim 1, wherein the drive device is attached below the door opening.

10. A passenger vehicle comprising at least a door opening and a sliding door device with a door, wherein the sliding door device is configured such that the door, in the closed state, is aligned with the side wall, whereas the door, in the opened state, rests outside against the side wall, wherein the sliding door device comprises the door and a drive device for moving the door transversely to and along a longitudinal axis of the passenger vehicle, and the drive device is disposed below or above a door opening of the passenger vehicle and comprises a support to which a first slide is attached in a manner displaceable along a longitudinal axis of the support, wherein, due to the displacement along the longitudinal axis of the support of the first slide, a displacement of a second slide relative to the support along the longitudinal axis of the support is caused via a transmission, and the door is attached to the second slide, and that the support is displaceably mounted, relative to the passenger vehicle, in a direction transverse to the longitudinal axis of the passenger vehicle, and the first slide is connected to a driver guided within a first guide track that is fixedly located on the passenger vehicle, and a second guide track, in which a guide member is guided that is connected to the door, is located on the side of the door opening opposite from the drive device.

* * * * *